US007941893B2

(12) United States Patent
Wörwag

(10) Patent No.: US 7,941,893 B2
(45) Date of Patent: May 17, 2011

(54) VACUUM CLEANING TOOL AND METHOD FOR ITS OPERATION

(75) Inventor: Peter Wörwag, Staad (CH)

(73) Assignee: Düpro AG, Romanshorn (CH)

( * ) Notice: Subject to any disclaimer, the term of this patent is extended or adjusted under 35 U.S.C. 154(b) by 825 days.

(21) Appl. No.: 11/847,439

(22) Filed: Aug. 30, 2007

(65) Prior Publication Data

US 2008/0053479 A1 Mar. 6, 2008

(30) Foreign Application Priority Data

Aug. 30, 2006 (DE) ..... 10 2006 040 557

(51) Int. Cl.
*A47L 9/14* (2006.01)

(52) U.S. Cl. ..... 15/319; 15/339; 15/383; 15/419

(58) Field of Classification Search ..... 15/319, 15/339, 419, 383; *A47L 9/14*
See application file for complete search history.

(56) References Cited

U.S. PATENT DOCUMENTS 6,099,661 A * 8/2000 Conrad ..... 134/21
6,813,809 B2 11/2004 Wörwag

* cited by examiner

*Primary Examiner* — David A Redding
(74) *Attorney, Agent, or Firm* — Gudrun E. Huckett

(57) ABSTRACT

A vacuum cleaning tool has a housing having a connecting socket for effecting flow communication to a vacuum device of a vacuum cleaning device. The housing has a suction opening through which a working air flow enters the housing. The housing has an outlet opening through which the working air flow exits from the housing. A cleaning tool is rotatably supported in the housing. An air turbine is rotatably supported in a turbine chamber of the housing and drives the cleaning tool in rotation. A control device controls the drive power for driving the cleaning tool based on a pressure existing in the vacuum cleaning tool.

12 Claims, 4 Drawing Sheets

Fig. 4
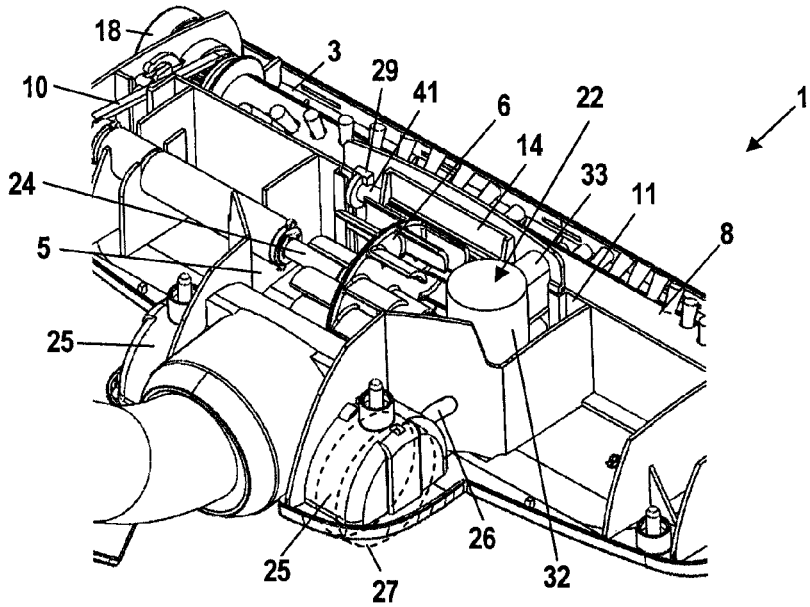
Fig. 5
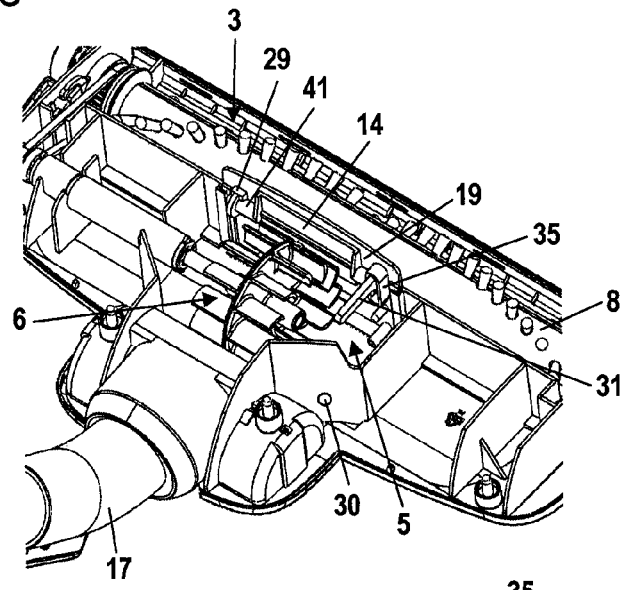
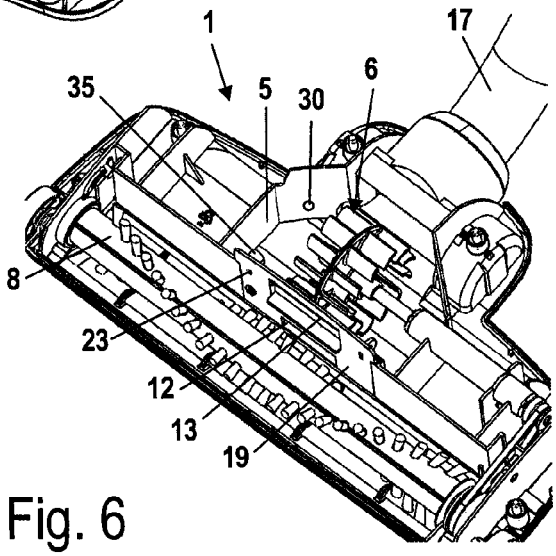
Fig. 6

VACUUM CLEANING TOOL AND METHOD FOR ITS OPERATION

BACKGROUND OF THE INVENTION

The invention relates to a vacuum cleaning tool comprising a housing provided with: a connecting socket for flow communication with a vacuum device of a vacuum cleaning device; an intake opening through which the working air flow enters the housing; an outlet opening through which the working air flow exits from the housing; a cleaning tool that is rotatably supported in the housing; and an air turbine for rotatingly driving the cleaning tool, wherein the air turbine is supported rotatably in a turbine chamber. The invention further relates to a method for operating such a vacuum cleaning tool.

U.S. Pat. No. 6,813,809 discloses a vacuum cleaning tool comprising an air turbine that rotatingly drives the cleaning tool. For different types of floor coverings different speeds of the cleaning tool are desirable. The speed of the cleaning tool varies also as a function of the vacuum power of the vacuum device. In the device of U.S. Pat. No. 6,813,809, a manual adjustment is provided for adjusting the turbine power.

However, it has been found that the operator during operation often does not carry out an optimal adjustment of the turbine power. The adjustment of the turbine power to different floor coverings is often not done at all or not done to a satisfactory degree so that an insufficient cleaning result may be achieved.

SUMMARY OF THE INVENTION

It is an object of the present invention to provide a vacuum cleaning tool of the aforementioned kind with which an excellent adjustment of the drive power can be achieved.

A further object of the invention is to provide a method for operating a vacuum cleaning tool with which an excellent cleaning result can be achieved.

In accordance with the present invention, this is achieved for a vacuum cleaning tool in that the vacuum cleaning tool has a control device for controlling the drive power of the cleaning tool as a function of the pressure in the vacuum cleaning tool.

This is achieved for the method of the aforementioned kind in that the drive power of the cleaning tool is controlled as a function of the pressure in the vacuum cleaning tool.

The drive power of the cleaning tool is to be adjusted to the vacuuming power of the vacuum device as well as to different floor coverings. For example, on hard floors such as wood floors or tile floors, a reduced drive power of the cleaning tool is desirable in comparison to the drive power on carpeting. In the area of fringes of the carpet, the drive power should also be minimal. It was found that all these different factors have an effect on the pressure in the vacuum cleaning tool. By controlling the drive power as a function of pressure in the vacuum cleaning tool, it is thus possible in a simple way to provide an adjustment of the drive power that takes into consideration different drive powers of the vacuum devices as well as the different types of floor coverings. The vacuum cleaning tool can therefore be used with different vacuum cleaning devices of different power levels. The drive power of the cleaning tool is automatically adjusted to the drive power of the vacuum device. By controlling the drive power as a function of the pressure in the vacuum cleaning tool, the drive power can be adjusted to a high level on carpeting where a high underpressure in the vacuum cleaning tool is generated while for use of the vacuum cleaning tool on hard floors or fringes a minimal drive power is desirable. In these cases, the underpressure that is produced within the vacuum cleaning tool is reduced. Thus, the pressure difference relative to ambient pressure is thus smaller. In the lifted state of the vacuum cleaning tool, the under pressure is also minimal. In this situation, the drive power is also reduced. The reduced drive power provided on hard floors and when the vacuum cleaning tool is lifted off the floor also leads to reduced noise development of the tool. A control device for controlling the drive power can be retrofitted on existing vacuum cleaning tools.

Advantageously, the control device has a pressure sensor. The drive device is in particular an air turbine that is rotatably supported in a turbine chamber wherein the air turbine is driven by a first suction air flow that is taken in through the suction opening and wherein the control device adjusts the first suction air flow. By adjusting the suction air flow, the turbine power and accordingly the drive power of the cleaning tool can be acted on in a simple way. The first suction air flow is advantageously at least one portion of the working air flow. The first suction air flow serves in this way for driving the air turbine as well as for conveying the dirt particles.

It is proposed that the cleaning tool is arranged in a working chamber into which the suction opening opens and that the turbine chamber is connected to the working chamber by means of at least one flow connection. The control device acts advantageously on the flow cross-section of at least one flow connection. In this way, the suction air flow can be adjusted in a simple way. Advantageously, at the flow connection a control element is arranged and the control device acts on the position of the control element. In particular, at least at one flow connection an adjusting device is provided with which the flow cross-section of the flow connection can be adjusted independent of the pressure in the vacuum cleaning tool. Advantageously, the adjusting device is manually actuated. By means of the adjusting device, the maximum flow cross-section of a flow connection in particular can be adjusted. The control element controlled by the control device can then act on this flow cross-section. The adjusting device can also be arranged, or can additionally be arranged, on a flow connection that is not acted upon by the control element.

A simple configuration of a control device can be achieved when the pressure sensor comprises a diaphragm wherein ambient pressure acts on one face of the diaphragm and the pressure in the vacuum cleaning tool acts on the opposite diaphragm face. The position of the control element is advantageously coupled to the deflection of the diaphragm. The deflection of the diaphragm provides a measure of the differential pressure between the ambient pressure and the pressure in the vacuum cleaning tool. By means of the diaphragm, the differential pressure can be converted in a simple way into an adjusting travel. A control device configured in this way is of a simple and robust construction. Expediently, the deflection of the diaphragm is coupled to the control element by means of a control lever that is fixedly connected to the control element. In this way, a simple constructive design is achieved. By means of the configuration of the control lever and of the diaphragm as well as by means of the configuration of the control element the desired adjustment of the drive power of the cleaning tool can be achieved.

It can also be provided that the pressure sensor comprises a bellows that communicates with one end with the interior of the vacuum cleaning tool and with the other end with the surroundings, wherein one end of the bellows is stationarily arranged in the housing and the position of the control element is coupled to the position of the other end of the bellows. With increasing differential pressure, the bellows will contract and, in this way, effects a change of the position of the second end of the bellows. It is thus also possible by means of a bellows to convert a differential pressure in a simple way to an adjusting travel.

It is provided that the working chamber and the turbine chamber are connected by means of a first flow connection and a second flow connection wherein the suction air flow driving the air turbine flows through the first flow connection. By dividing the working air flow into a first air flow flowing through the first flow connection and a second air flow flowing through the second flow connection, it is thus possible to act on the drive power of the air turbine.

A reduced running noise of the air turbine can be achieved when the first flow connection and the second flow connection are positioned on opposite sides of an imaginary plane determined by the axis of rotation of the air turbine and the center of the outlet opening. The suction air flow flows through the flow connection in the driving direction against the air turbine and contributes to the drive power. The suction air flow flowing through the other air flow connection impinges in the opposite directions on the air turbine and therefore does not contribute to the drive power. This suction air flow generates a braking action on the air turbine. It has been found that the flow action on two sides of the air turbine reduces the running noise of the air turbine significantly. As a result of the arrangement of the first and second flow connections, on the one hand, a very simple, excellent intervention in the drive power of the air turbine can be achieved and, on the other hand, the noise development of the vacuum cleaning tool can be reduced. In this connection, it is provided that the entire working air flow flows through the first or the second flow connection from the working chamber into the turbine chamber. The entire working air flow is therefore used for transporting particles from the suction opening to the outlet opening. The control of the drive power causes no loss of working air. An excellent intervention in the drive power is achieved when the control device acts on the flow cross-section of the second flow connection. Adjusting the flow cross-section of the second flow connection enables excellent control of the drive power. The change of the air flow flowing through the second flow connection effects also a change of the air flow through the first flow connection because the control device adjusts how the working air flow is divided onto the two flow connections. In this connection, the total suction air flow remains essentially the same. Thus, the reduction of the flow cross-section of the second flow connection has the effect of increasing the air flow through the first flow connection and vice versa.

It can also be provided that the control device comprises a control that actuates a servo motor for the control element on the flow connection as a function of a pressure in the vacuum cleaning tool. It can also be provided that the control device comprises a control and a drive motor that rotatingly drives the cleaning tool, wherein the control controls the drive motor as a function of pressure in the vacuum cleaning tool. By means of the pressure in this case the drive power of the cleaning tool is directly controlled. In this connection, the current input, the drive power or the speed of the drive motor can be controlled, for example.

In a method for operating a vacuum cleaning tool having a housing that comprises a connecting socket for flow communication with a vacuum device of a vacuum cleaning device; a suction opening through which the working air flow flows into the housing; an outlet opening through which the working air flow exits from the housing; a cleaning tool that is rotatably supported in the housing; and a drive device for rotatingly driving the cleaning tool, it is provided that the drive power of the cleaning tool is controlled as a function of a pressure in the vacuum cleaning tool.

The control of the drive power as a function of the pressure in the vacuum cleaning tool enables an automatic adjustment of the drive power and thus of the speed of the cleaning tool with regard to different floor coverings. A manual adjustment by the operator is not needed.

Advantageously, between a lower pressure value and an upper pressure value, the drive power is increased for a pressure drop in the vacuum cleaning tool and is lowered for a pressure increase in the vacuum cleaning tool. On carpeting, a high underpressure results, i.e., a low absolute pressure value in the vacuum cleaning tool. Upon operation on carpeting, a high drive power of the vacuum cleaning tool is desirable. On hard floors, carpet fringes and when the vacuum cleaning tool is lifted, the drive power should be minimal. In this case, a comparatively high absolute pressure will result, i.e., an only minimal underpressure within the vacuum cleaning tool. For such a high pressure, a low drive power is provided.

Advantageously, the drive power above is not changed above an upper pressure value. The upper pressure value can be, for example, the underpressure that results when the vacuum cleaning tool is lifted off the ground. Advantageously, the drive power is controlled as a function of a differential pressure between a pressure in the vacuum cleaning tool and the ambient pressure.

BRIEF DESCRIPTION OF THE DRAWING

FIG. 4 is a second perspective illustration of the vacuum cleaning tool with removed upper housing shell.

FIG. 5 is a third perspective illustration of the vacuum cleaning tool with removed upper housing shell.

FIG. 6 is a fourth perspective illustration of the vacuum cleaning tool with removed upper housing shell.

DESCRIPTION OF THE PREFERRED EMBODIMENTS

Figure 1:
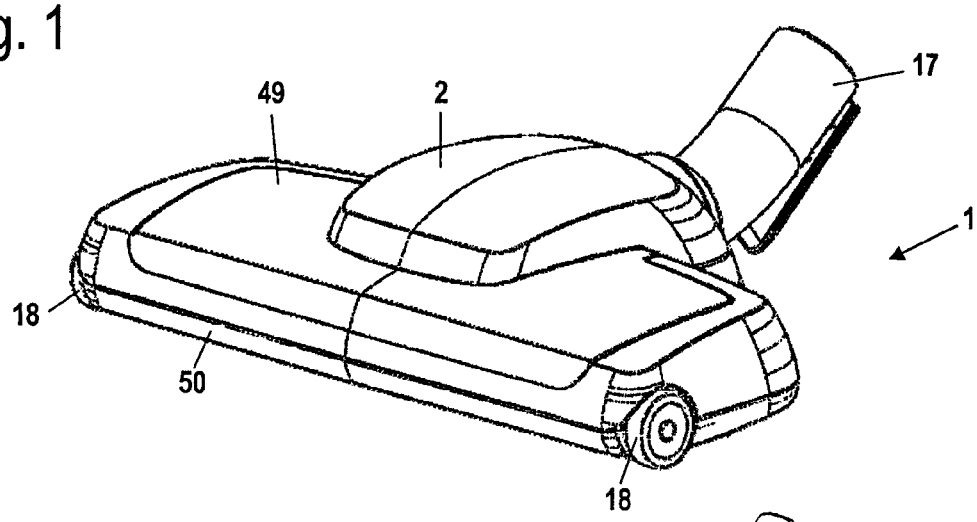
FIG. 1 is a perspective illustration of a vacuum cleaning tool according to the invention.

The vacuum cleaning tool 1 illustrated in FIG. 1 has a housing 2 that is comprised of an upper housing shell 49 and a lower housing shell 50. Two front wheels 18 are rotatably supported on the housing 2. A connecting socket 17 for connecting the vacuum cleaning tool 1 to a vacuum device of a vacuum cleaning device is arranged on the housing 2 of the vacuum cleaning tool 1.

Figure 2:
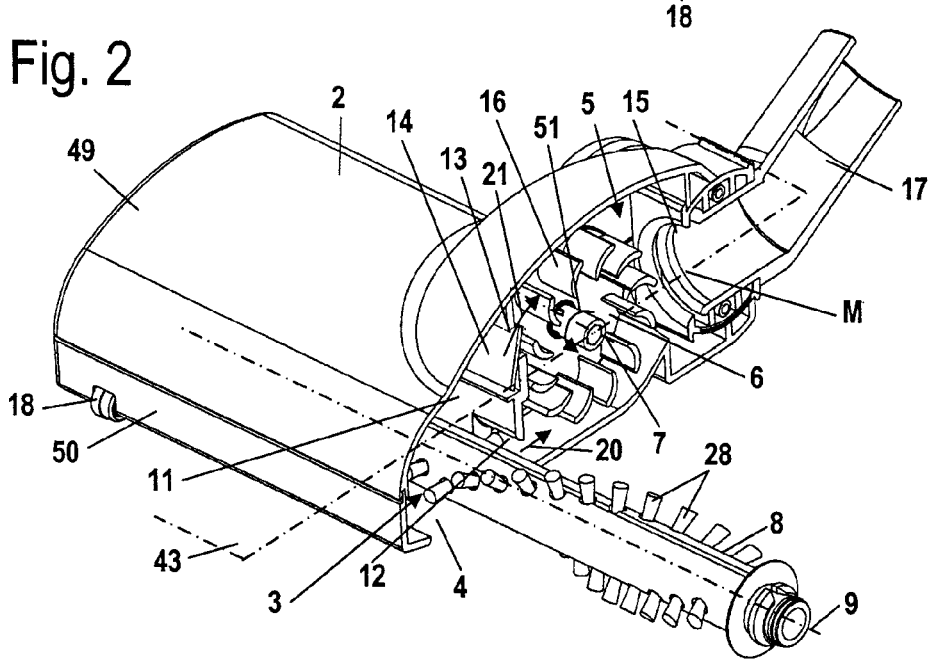
FIG. 2 is a perspective illustration showing a longitudinal section of a vacuum cleaning tool according to the invention.

In FIG. 2, the vacuum cleaning tool 1 is shown in a section view. The front wheel 18, as shown in FIG. 2, can also be arranged at the front side of the housing 2. In the lower housing shell 50, a suction opening 4 is provided that extends across the entire width of the vacuum cleaning tool 1 transversely to the working direction. The suction opening 4 is slot-shaped. Above the suction opening 4 a cleaning tool, i.e., a brush roller 8, is supported to be rotatable about axis of rotation 9. A plurality of bristles 28 are secured on the brush roller 8. The housing 2 is divided transversely to the working direction and parallel to the axis of rotation 9 of the brush roller 8 by a partition 11 into a working chamber 3 in which the brush roller 8 is arranged and a turbine chamber 5 in which an air turbine 6 is rotatably supported. The air turbine 6 is rotatably supported about axis of rotation 7 that is parallel to the axis of rotation 9 of the brush roller 8.

The turbine chamber 5 is in fluid communication by means of first flow connection 12 and by means of second flow connection 13 with the turbine chamber 5. The first flow connection 12 is of an open configuration. On the second flow connection 13 a control element, i.e., a control flap 14, is arranged that controls the flow cross-section of the second flow connection 13. An outlet opening 15 is provided on the turbine chamber 5 to which is connected the connecting socket 17. In operation, the vacuum device of the vacuum cleaning device connected to the connecting socket 17 conveys the working air flow through suction opening 4 into the working chamber 3. From the working chamber 3, the working air flow flows via the flow connections 12 and 13 into the turbine chamber 5 and via the outlet opening 15 out of the connecting socket 17. The total air flow that is conveyed by the vacuum device serves as a working air flow for conveying dirt particles from the suction opening 4 to the outlet opening 15.

In FIG. 2 an imaginary plane 43 is shown that contains the axis of rotation 7 of the air turbine 6 as well as the geometric center M of the outlet opening 15. The first flow connection 12 is below the plane 43, i.e. on the side of the plane 43 where the suction opening 4 is located, and the second flow connection 13 is arranged above the plane 43. A first suction air flow that flows in the direction of arrow 20 through the first flow connection 12 drives the air turbine 6 in rotational direction 51. A second suction air flow branched off the working air flow flows in the direction of arrow 21 through the second flow connection 13 into the turbine chamber 5. The suction air flow that enters the turbine chamber 5 through the second flow connection 13 brakes the air turbine 6. At the same time, the second suction air flow provides an air cushion between the housing 2 and the air turbine 6 that results in a reduction of the running noise of the air turbine 6.

Figure 3:
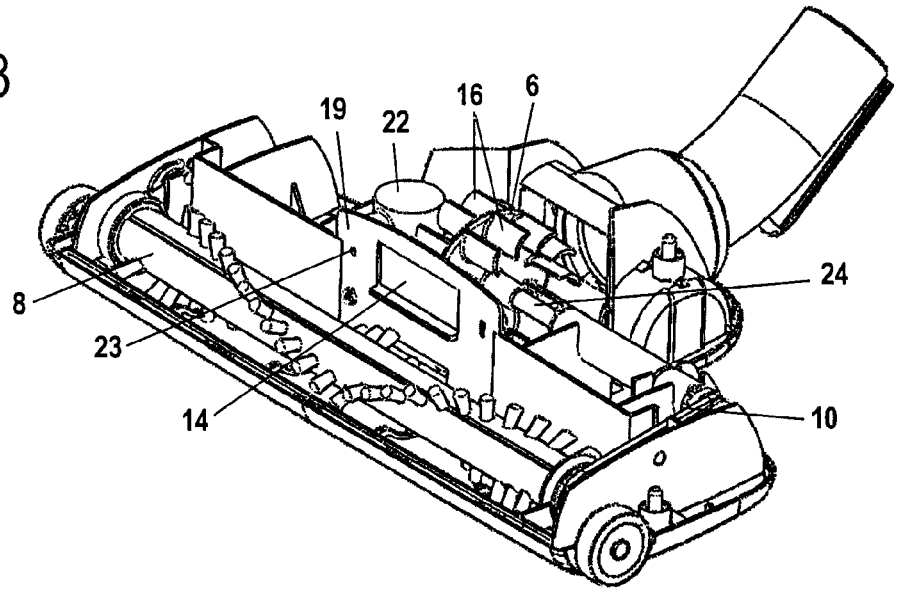
FIG. 3 is a first perspective illustration of the vacuum cleaning tool with removed upper housing shell.

FIG. 3 shows that the air turbine 6 has turbine vanes 16 on both faces of a baseplate 52. It can also be provided to arrange turbine vanes 16 only on one face of the baseplate 52. As shown in FIGS. 2 and 3, the air turbine 6 is designed as a cross-flow turbine. Sucked-in air can flow through the turbine vanes 16 into the area of the axis of the air turbine 6 and from there through additional turbine vanes 16 radially outwardly.

As shown in FIG. 3, a section of the partition 11 is formed on an insert 19. The flow connections 12 and 13 are arranged on the insert 19. For controlling the control flap 14 a control device 22 is provided. The control device 22 is in communication with a pressure measuring opening 23 in the insert 19; the opening 23 opens into the working chamber 3. The air turbine 6 drives the brush roller 8 by means of drive shaft 24 and drive belt 10.

In FIG. 4, the vacuum cleaning tool 1 with its control device 22 is shown. The control device 22 has a housing 32 that is arranged in the turbine chamber 5. The housing 32 has a connecting socket 33 connected to the insert 19. In FIG. 6, the vacuum cleaning tool 1 is shown without control device 22. As shown in FIG. 6, in the area of the pressure measuring opening 23 and of the connecting socket 33 on the insert 19, a guide 35 is arranged onto which the connecting socket 33 can be pushed into place. As shown in FIG. 5 and FIG. 6, the wall of the turbine chamber 5 has a connecting opening 30 through which a connecting hose 26 illustrated in FIG. 4 extends. The connecting hose 26 connects the interior of the housing 32 of the control device 22 with ambient air. The connecting hose 26 opens into the interior of a wheel cover 25. In FIG. 4, schematically a rear wheel 27 is illustrated that is arranged underneath the wheel cover 25. The interior of the wheel cover 25 is protected from becoming soiled so that clogging of the connecting hose 26 with dirt particles is prevented. The control device 22 can be retrofitted in existing vacuum cleaning tools by exchanging an existing insert for an insert 19 with the control device 22.

In FIG. 5, the arrangement of a control lever 31 of the control device 22 is illustrated. The control lever 31 has a short end that is positioned in the area of the guide 35 on the insert 19; the long end of the control lever 31 projects into the housing 32 (not shown in FIG. 5) of the control device 22. As shown in FIGS. 4 and 5, the control flap 14 is arranged on a bearing shaft 41 that is supported on the side opposite the control device 22 in a bearing 29 provided on the insert 19. The housing of the control device 22 is connected by means of a fastening screw 36 to the insert 19.

Figure 7:
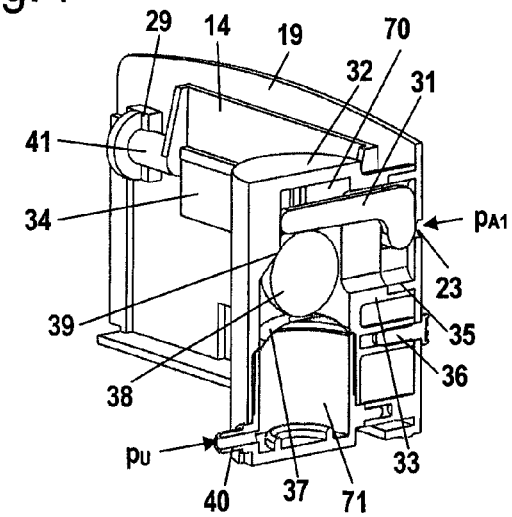
FIG. 7 shows a control device in a perspective partially sectioned illustration.

In FIGS. 7 through 12, the function of the control device 22 is illustrated. As shown in FIG. 7, in the interior of the housing 32 a diaphragm 37 is arranged that is attached sealingly on the inner circumference of the housing 32. On one face of the diaphragm 37 there is a control ball 38 on which the long end of the control lever 31 rests. In the completely closed position of the control flap 14 shown in FIG. 7, the control ball 38 rests against a stop 39 in the housing 32. The control lever 31 and the control ball 38 are arranged in a first chamber 70 in the housing 32. The pressure measuring opening 23 opens into this first chamber 70 of the housing 32. The control lever 31 is positioned in the area of the pressure measuring opening 23 so as to neighbor the insert 19 but it does not closed off the opening 23. A first pressure $p_{A1}$ of the working chamber 3 is present in the first chamber 70 because of the pressure measuring opening 23. The diaphragm 37 separates the first chamber 70 from a second chamber 71 that is connected by means of connecting socket 40 to ambient air. The connecting hose 26 is secured on the connecting socket 40 as shown in FIG. 4. In the second chamber 71 ambient pressure $p_u$ is present.

Figure 8:
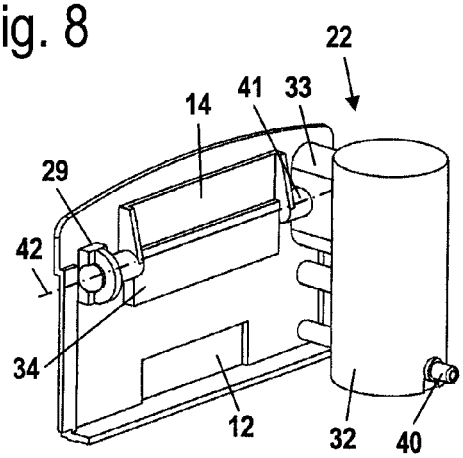
FIG. 8 shows the control device according to FIG. 7 in a perspective illustration.
Figure 9:
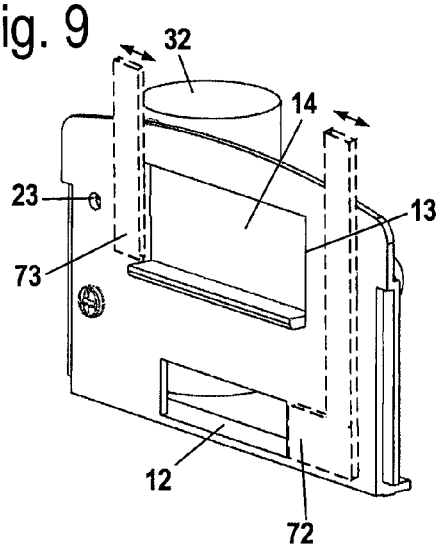
FIG. 9 is another perspective illustration of the control device according to FIG. 7.

As shown in FIG. 8, the bearing shaft 41 is supported on the connecting socket 33. The control lever 31 is fixedly connected to the bearing shaft 41. As shown in FIG. 9, the control flap 14 extends across the entire height of the second flow connection 13. As shown in FIGS. 7 and 8, the side of the second flow connection 13 that is facing the first flow connection 12 and is positioned below the axis of rotation 42 of the bearing shaft 41 is closed off on the side facing the turbine chamber 5 by wall section 34.

In the completely closed position of the control flap 14 illustrated in FIG. 7 through 9, the pressure $p_{A1}$ present in the working chamber 3 is significantly lower than the ambient pressure $p_u$. In the working chamber 3 a high underpressure is present as it exists, for example, in operation of the vacuum cleaning tool 1 on carpeting. The ambient pressure $p_u$ forces by means of control ball 38 the control lever 31 upwardly so that the control flap 14 is forced into the completely closed position. In this position the entire working air flow flows through the first flow connection 12 from the working chamber 3 into the turbine chamber 5.

Figure 10:
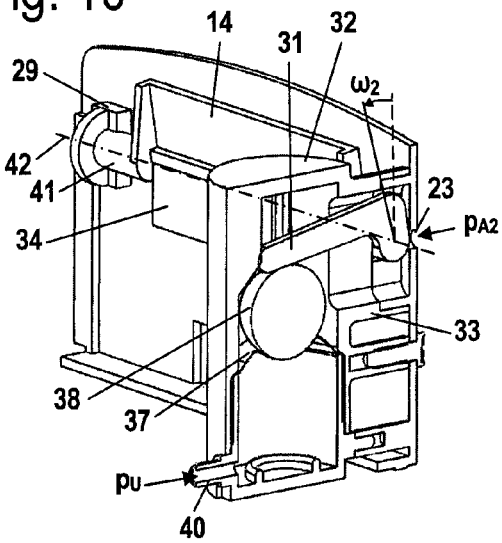
FIG. 10 shows the control device of FIG. 7 in a perspective, partially sectioned illustration in a first control position.

In FIG. 10, the position of the control flap 14 at reduced underpressure, i.e., increased absolute pressure $p_{A2}$ in the working chamber 3, is illustrated. At increased pressure $p_{A2}$ in the working chamber 3, the control flap 14 as a result of the suction action of the vacuum device is rotated into an open position. This opening action of the control flap 14 is possible because the wall section 34 covers the wall section of the control flap 14 acting in the opposite direction. The pressure $p_{A2}$ in the working chamber 3 no longer is sufficient in order to deflect the diaphragm 37 completely upwardly. The control lever 31 is pivoted relative to the position illustrated in FIG. 7 by an angle $\omega_2$ about axis of rotation 42. In this way, a second suction air flow flows via the second flow connection 13 out of the working chamber 3 into the turbine chamber 5. The second suction air flow is no longer available as a driving air flow for the air turbine 6. The second suction air flow brakes the air turbine 6. In this way, the speed of the air turbine 6 and thus the drive power at which the brush roller 8 is driven in rotation are reduced. At increased pressure $p_{A2}$ in the working chamber 3 as it exists, for example, when driving across carpet fringes, the speed of the brush roller 8 is reduced as a result of the reduced drive power.

Figure 11:
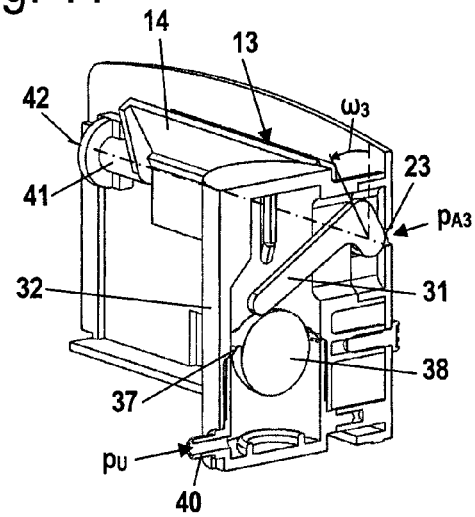
FIG. 11 shows the control device of FIG. 7 in a perspective partially sectioned illustration in a second control position.
Figure 12:
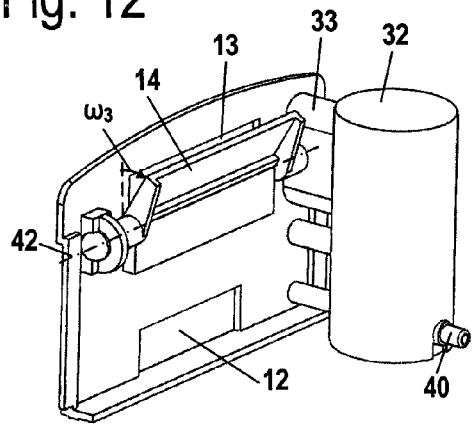
FIG. 12 is a perspective illustration of the control device in the control position shown in FIG. 11.

FIGS. 11 and 12 show the control device 22 at farther increased pressure $p_{A3}$ in the working chamber 3. The vacuum device has deflected the control flap 14 farther. The vacuum power acting on the control flap 14 remains constant but the underpressure acting on the diaphragm 37 in the direction toward the control lever 31 decreases as a result of the increased pressure in the working chamber 3 so that the force counteracting the deflection of the control flap 14 is reduced. The control lever 31 in the position illustrated in FIGS. 11 and 12 has been deflected by an angle $\omega_3$ relative to the position illustrated in FIGS. 7 through 9. It can also be provided that the lever 31 acts directly on the diaphragm 37.

Adjusting devices 72 and 73 can be arranged at the flow connections 12 and 13 as indicated in dashed lines in FIG. 9. On the first flow connection 12 an adjusting device 72 is arranged that is configured as a manually actuatable control slide. The control slide can be moved by the user in the direction of the arrow shown in FIG. 9. In this way, the cross-section of the first flow connection 12 is changed independent of the pressures existing within the vacuum cleaning tool 1. At the second flow connection 13, an adjusting device 73 is arranged that is also configured as a manually adjustable control slide. The control slide can also be moved by the user in the direction of the arrow shown in FIG. 9. It can also be provided to arrange an adjusting device 72, 73 either at the first flow connection 12 or at the second flow connection 13. Depending on the desired effect on the flow cross-section of the flow connections 12 and 13, the size of the adjusting devices 72 and 73 can be selected to be different. By means of the adjusting devices 72 and 73, the maximum flow cross-section of the flow connections 12 or 13 are determined. In this way, the division of the air flow onto the two flow connections 12 and 13 can be adjusted also. The control of the control flap 14 at the second flow connection 13 is independent of the position of the adjusting devices 72 and 73. Instead of providing a slide, the adjusting devices 72 and 73 can be configured also in other ways, for example, as an adjusting flap or the like.

Figure 13:
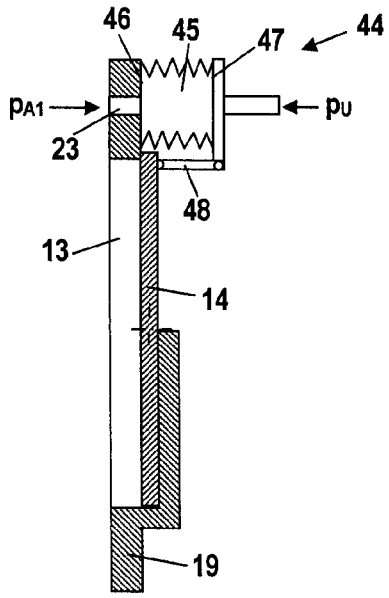
FIG. 13 is a schematic section illustration of a control device in a first control position.
Figure 14:
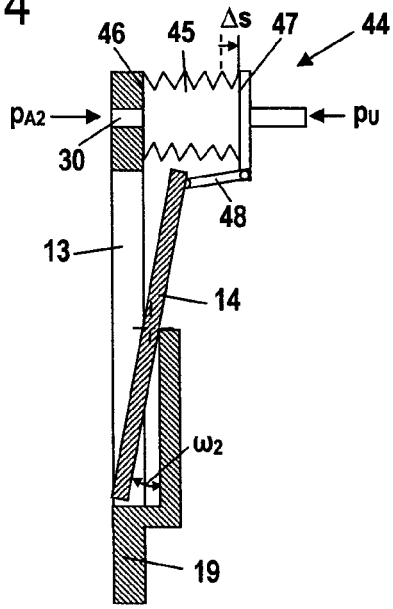
FIG. 14 is a schematic section illustration of the control device in a second control position.

FIGS. 13 and 14 show an embodiment of a control device 44. The control device 44 comprises a bellows 45 whose first end 46 is secured to the insert 19. The first end 46 of the bellows 45 is connected by means of pressure measuring opening 23 to the working chamber 3. The second end 47 of the bellows 45 is connected to ambient pressure $p_u$. At the second end 47 of the bellows 45, a lever 48 is arranged; by means of the lever 48 the second end 47 of the bellows 45 is connected to the control flap 14. At high underpressure in the working chamber 3, i.e., a small absolute pressure value $p_{A1}$, the underpressure pulls the second end 47 toward the insert 19. The openings in the bellows 45 toward the working chamber 3 and the surroundings are very small so that no significant flow occurs. The control flap 14 is closed. When the absolute pressure is increased to the pressure $p_{A2}$ indicated in FIG. 14, the force that acts on the second end 47 is no longer sufficient to counteract the force acting on the control flap 14 as a result of the underpressure in the turbine chamber 5. The second end 47 of the bellows 45 moves by the travel stroke $\Delta S$ away from the insert 19. The control flap 14 is opened by an angle $\omega_2$.

Instead of the diaphragm 37 or of the bellows 45, the control device can also comprise a valve for controlling the control flap 14. Instead of a control flap, other control elements such as slides or the like can be provided.

Figure 15:
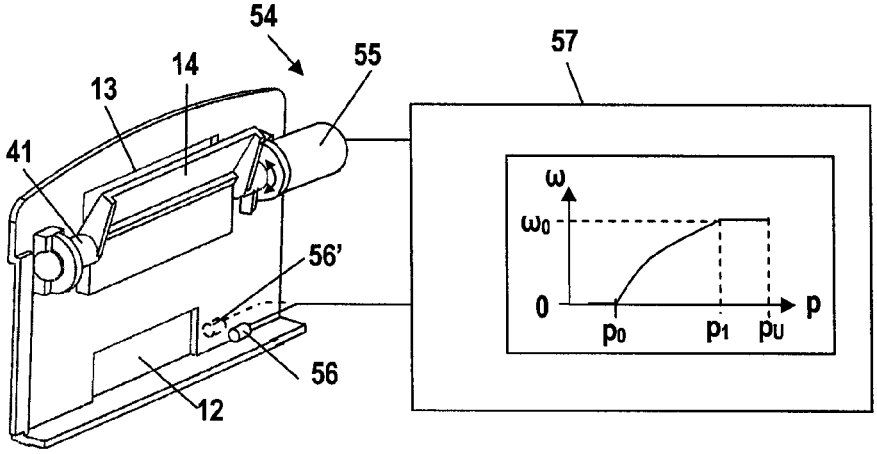
FIG. 15 is a schematic illustration of the function of a control device.

In FIG. 15 a further embodiment of a control device 54 is shown. The control device 54 comprises a servo motor 55 that acts on the shaft 41 of the control flap 14 and in this way adjusts the position of the control flap 14. The servo motor 55 is connected to a control 57. The control device 54 comprises a pressure senor 56 that measures the pressure in the turbine chamber 5. It is also possible to provide a pressure sensor 56' for detecting the pressure in the working chamber 3. As a function of the pressure measured by the pressure sensor 56 or 56' the control 57 controls the servo motor and thus the position of the control flap 14. The control is realized based on the schematically indicated diagram of FIG. 15 that shows the angle $\omega$ as a function of the measured pressure p. Below a lower pressure value $p_0$ the control flap 14 is closed. Below the lower pressure value $p_0$ the underpressure in the vacuum cleaning tool 1 is very large. As the pressure increases, i.e., underpressure relative to the surroundings decreases, the control flap 14 is adjusted by increasing the angle $\omega$. At an upper pressure value $p_1$ the control flap 14 is opened by maximum angle $\omega_0$. The pressure value $p_1$ can be present, for example, as the vacuum cleaning tool 1 is lifted off the ground. As the pressure increases even more, the control flap 14 remains unchanged until the ambient pressure $p_u$ is reached.

Figure 16:
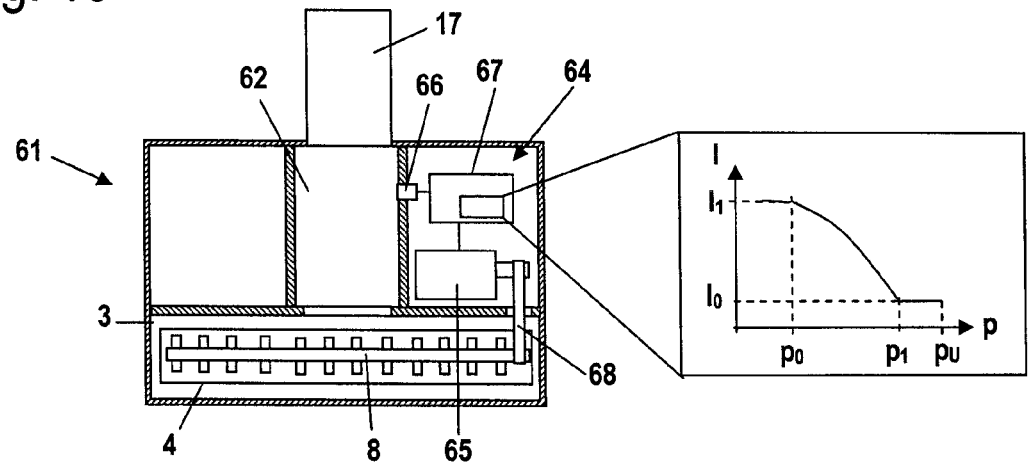
FIG. 16 is another schematic illustration of the function of a control device.

In the embodiment illustrated in FIG. 16, the brush roller 8 is driven directly by drive motor 65 and drive belt 68. An air turbine is not provided. The vacuum cleaning tool 61 illustrated in FIG. 16 has a working chamber 3 in which the brush roller 8 is arranged as well as a chamber 62 that connects the working chamber 3 to the connecting socket 17. The vacuum cleaning tool 61 has a control device 64 that comprises a drive motor 65 as well as a pressure sensor 66 and a control 67. The pressure sensor 66 measures the pressure in the chamber 62. The pressure sensor 66 however can also measure the pressure in the working chamber 3. The control 67 controls the current input I of the drive motor 65 and thus the drive power of the brush roller 8. The control is realized based on the schematically shown diagram of FIG. 16. At low pressure $p_0$, i.e., at high underpressure in the chamber 62, the drive motor 65 is operated at high current $I_1$. With increasing pressure, i.e.

decreasing underpressure in the chamber 62, the current input I also decreases to a current input $I_0$ at an upper pressure value $p_1$. Until the ambient pressure $p_u$ is reached, the current input I is maintained constant. However, it is also possible to further lower the current input I after surpassing the upper pressure value $p_1$. In particular, it can be provided that when an upper pressure value is reached, the drive motor 65 is switched off for safety reasons, for example, when the vacuum cleaning tool 61 is lifted off the ground. Instead of the current input I, the speed or the drive power of the drive motor 65 can be controlled.

The specification incorporates by reference the entire disclosure of German priority document 10 2006 040 557.9 having a filing date of 30 Aug. 2006.

While specific embodiments of the invention have been shown and described in detail to illustrate the inventive principles, it will be understood that the invention may be embodied otherwise without departing from such principles.

What is claimed is:

1. A vacuum cleaning tool comprising:

a housing having a connecting socket for effecting flow communication to a vacuum device of a vacuum cleaning device;

the housing having a suction opening through which a working air flowenters the housing;

the housing having an outlet opening through which the working air flowexits from the housing;

a cleaning tool rotatably supported in the housing;

an air turbine rotatably supported in a turbine chamber of the housing, wherein the air turbine drives the cleaning tool in rotation;

a control device for controlling a drive power for driving the cleaning tool based on a pressure existing in the vacuum cleaning tool;

wherein the control device comprises a pressure sensor;

wherein the air turbine is driven by a first suction air flow taken in through the suction opening, wherein the control device adjusts the first suction air flow;

wherein the cleaning tool is arranged in a working chamber of the housing, wherein the suction opening opens into the working chamber, wherein the turbine chamber and the working chamber are connected by one or more flow connections, and wherein the control device acts on a flow cross-section of at least one of the one or more flow connections.

2. The vacuum cleaning tool according to claim 1, wherein the first suction air flow is at least a portion of the working air flow.

3. The vacuum cleaning tool according to claim 1, further comprising a control element arranged at said at least one of the one or more flow connections, wherein the control device acts on the control element to adjust a position of the control element.

4. The vacuum cleaning tool according to claim 3, wherein the pressure sensor comprises a diaphragm having a first face and a second face, wherein ambient pressure acts on the first face and the pressure in the vacuum cleaning tool acts on the second face, wherein the control element is coupled to the diaphragm so that a position of the control element is coupled to a deflection of the diaphragm.

5. The vacuum cleaning tool according to claim 4, wherein a control lever is fixedly connected to the control element and wherein the deflection of the diaphragm is coupled by the control lever to the control element.

6. The vacuum cleaning tool according to claim 3, wherein the pressure sensor comprises a bellows having a first end and a second end, wherein the first end communicates with an interior of the vacuum cleaning tool and wherein the second end communicates with ambientair, wherein one of the first and second ends is stationarily connected to the housing and wherein a position of the control element is coupled to a position of the other one of the first and second ends.

7. The vacuum cleaning tool according to claim 3, wherein the control device comprises a control that actuates a servo motor for the control element based on the pressure in the vacuum cleaning tool.

8. The vacuum cleaning tool according to claim 1, further comprising at least one adjusting device arranged on at least one of the one or more flow connections, wherein a flow cross-section of said at least one of the one or more flow connections is adjusted by the at least one adjusting device.

9. A vacuum cleaning tool comprising;

a housing having a connecting socket for effecting flow communication to a vacuum device of a vacuum deaning device;

the housing having a suction opening through which a working air flow enters the housing;

the housing having an outlet opening through which the working air flow exits from the housing;

a cleaning tool rotatably supported in the housing;

an air turbine rotatably supported in a turbine chamber of the housing, wherein the air turbine drives the cleaning tool in rotation;

a control device for controlling a drive power for driving the cleaning tool based on a pressure existing in the vacuum cleaning tool;

wherein the control device comprises a pressure sensor;

wherein the air turbine is driven by a first suction air flow taken in through the suction opening, wherein the control device adjusts the first suction air flow;

wherein the cleaning tool is arranged in a working chamber of the housing, wherein the suction opening opens into the working chamber, wherein the turbine chamber and the working chamber are connected to one another by a first flow connection and a second flow connection, wherein the control device acts on a flow cross-section of at least one of the first and second flow connections, wherein the first suction air flow driving the air turbine flows through the first flow connection.

10. The vacuum cleaning tool according to claim 9, wherein the first flow connection and the second flow connection are located on opposite sides of an imaginary plane that is defined by an axis of rotation of the air turbine and a center of the outlet opening.

11. The vacuum cleaning tool according to claim 9, wherein the working air flow flows entirely through the first flow connection or entirely through the second flow connection from the working chamber into the turbine chamber.

12. The vacuum cleaning tool according to claim 9, wherein the control device acts on the flow cross-section of the second flow connection.

* * * * *